US006963290B2

(12) United States Patent
Marsh et al.

(10) Patent No.: US 6,963,290 B2
(45) Date of Patent: Nov. 8, 2005

(54) DATA RECOVERY FOR PULSE TELEMETRY USING PULSE POSITION MODULATION

(75) Inventors: Laban M. Marsh, Houston, TX (US); Cili Sun, Sugarland, TX (US); Bipin K. Pillai, Houston, TX (US); Leonardo Viana, Baton Rouge, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 10/305,529

(22) Filed: Nov. 27, 2002

(65) Prior Publication Data

US 2004/0100866 A1 May 27, 2004

(51) Int. Cl.[7] ..... G08C 19/20

(52) U.S. Cl. ..... 340/870.19; 340/870.24; 340/853.1; 340/854.3; 375/254; 375/242; 367/83

(58) Field of Search ..... 340/853.1, 854.3, 340/870.19, 870.22, 870.24; 367/83; 375/242, 246, 254

(56) References Cited

U.S. PATENT DOCUMENTS

| | | | | |
|---|---|---|---|---|
| 4,764,769 A | * | 8/1988 | Hayworth et al. | 342/50 |
| 5,113,379 A | | 5/1992 | Scherbatskoy | 367/83 |
| 5,150,333 A | | 9/1992 | Scherbatskoy | 367/83 |
| 5,307,377 A | * | 4/1994 | Chouly et al. | 375/261 |
| 5,331,318 A | | 7/1994 | Montgomery | 340/855.4 |
| 5,353,303 A | * | 10/1994 | Walthall | 375/145 |
| 5,818,352 A | | 10/1998 | McClure | 340/854.6 |
| 5,822,330 A | * | 10/1998 | Buckland | 714/700 |
| 5,963,138 A | | 10/1999 | Gruenhagen | 340/679 |
| 6,021,095 A | | 2/2000 | Tubel et al. | 367/82 |
| 6,298,085 B1 | * | 10/2001 | Kondo et al. | 375/240 |
| 6,385,261 B1 | * | 5/2002 | Tsuji et al. | 375/346 |

FOREIGN PATENT DOCUMENTS

| | | |
|---|---|---|
| EP | 0 744 527 B1 | 5/1995 |
| WO | WO 97/14869 | 4/1997 |

OTHER PUBLICATIONS

U.S. Appl. No. 09/783,158; filed Feb. 14, 2001; titled: Downlink Telemetry System.

* cited by examiner

*Primary Examiner*—Albert K Wong
(74) *Attorney, Agent, or Firm*—Conley Rose, P.C.; Mark E. Scott

(57) ABSTRACT

The specification discloses algorithms for error recovery in pulse position modulation-based mud pulse telemetry. More particularly, the specification discloses detection and attempted correction of at least five possible error mechanisms: the missed detection of a pulse that creates an interval greater than maximum; the missed detection of a pulse that results in an interval still within acceptable boundaries; detection of an extra pulse; a pulse shift that results in data in contiguous intervals being affected; and a pulse shift resulting in a single interval data corruption.

48 Claims, 11 Drawing Sheets

DATA RECOVERY FOR PULSE TELEMETRY USING PULSE POSITION MODULATION

CROSS-REFERENCE TO RELATED APPLICATIONS

This application is related to application Ser. No. 10/306,487, titled "Structure and Method for Pulse Telemetry" assigned to the same Assignee, filed concurrently herewith, and which disclosure is incorporated by reference as if reproduced in full below.

STATEMENT REGARDING FEDERALLY SPONSORED RESEARCH OR DEVELOPMENT

Not applicable.

BACKGROUND OF THE INVENTION

1. Field of the Invention

The various embodiments of this invention are directed to error detection and recovery in pulse telemetry systems using pulse position modulation as the encoding scheme.

2. Background of the Invention

Measuring-while-drilling (MWD) and logging-while-drilling (LWD) systems gather data regarding the borehole and surrounding formations, and some of this information is most useful during the drilling process. For this reason, systems have been developed to transfer the information from downhole to the surface. One method of transferring the data from downhole to the surface is by encoding the data in pressure pulses of the drilling fluid within the drill string.

In ideal systems, each and every pressure pulse in the drilling fluid (also known as drilling mud or just mud) created downhole propagates to the surface and is detected by a pressure transducer or sensor and related electronics. However, drilling mud pressure fluctuates significantly and contains noise that tends to corrupt data transmission. The primary sources of noise are: 1) the mud pump; 2) torque noise; and 3) bit noise. Bit noise is created by vibration of the drill string during the drilling operation. As the bit moves and vibrates, bit jets where the drilling fluid exhausts can be partially or momentarily restricted, creating high frequency noise in the drilling fluid column. Torque noise is generated downhole by the action of the drill bit sticking in a formation, causing the drill string to torque up. The subsequent release of the drill bit relieves the torque on the drilling string and generates a low frequency, high-amplitude pressure surge. Finally, mud pumps themselves create cyclic noise as pistons within the mud pump force the drilling mud into the drill string. Thus, the drilling fluid pressure, upon which data is encoded, fluctuates wildly making pulse detection, and therefore data retrieval, difficult.

Thus, what is needed is a system and related method for detecting and, if possible, correcting, data transmission errors in mud pulse telemetry systems.

BRIEF SUMMARY OF SOME OF THE PREFERRED EMBODIMENTS

The problems noted above are solved in large part by a system and related method for detecting, and if possible, correcting data transmission errors in mud pulse telemetry systems using pulse position modulation encoding. In particular, embodiments of the invention detect and attempt to correct errors in five broad categories: (1) "Miss greater than maximum"; (2) "Miss less than maximum"; (3) the detection of an extra pulse; (4) detection of a pulse that shifted in time that adversely affects two intervals; and (5) shifting of a pulse which adversely affects only one interval. The "Miss greater than maximum" case represents a situation where a valid pulse is not detected, resulting in an interval whose duration is greater than a maximum defined for that interval. The "Miss less than maximum" case represents a situation where a true pulse is not detected, but the resulting interval duration is still less than a maximum defined for that interval. The extra pulse case may occur where an erroneous pulse is detected between two valid pulses. Finally, cases (4) and (5) represent situations where jitter in pulses, possibly caused by noise, may effect decoded values in one or more intervals.

The disclosed devices and methods comprise a combination of features and advantages which enable it to overcome the deficiencies of the prior art devices. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

NOTATION AND NOMENCLATURE

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

DETAILED DESCRIPTION OF THE PREFERRED EMBODIMENTS

Figure 1:
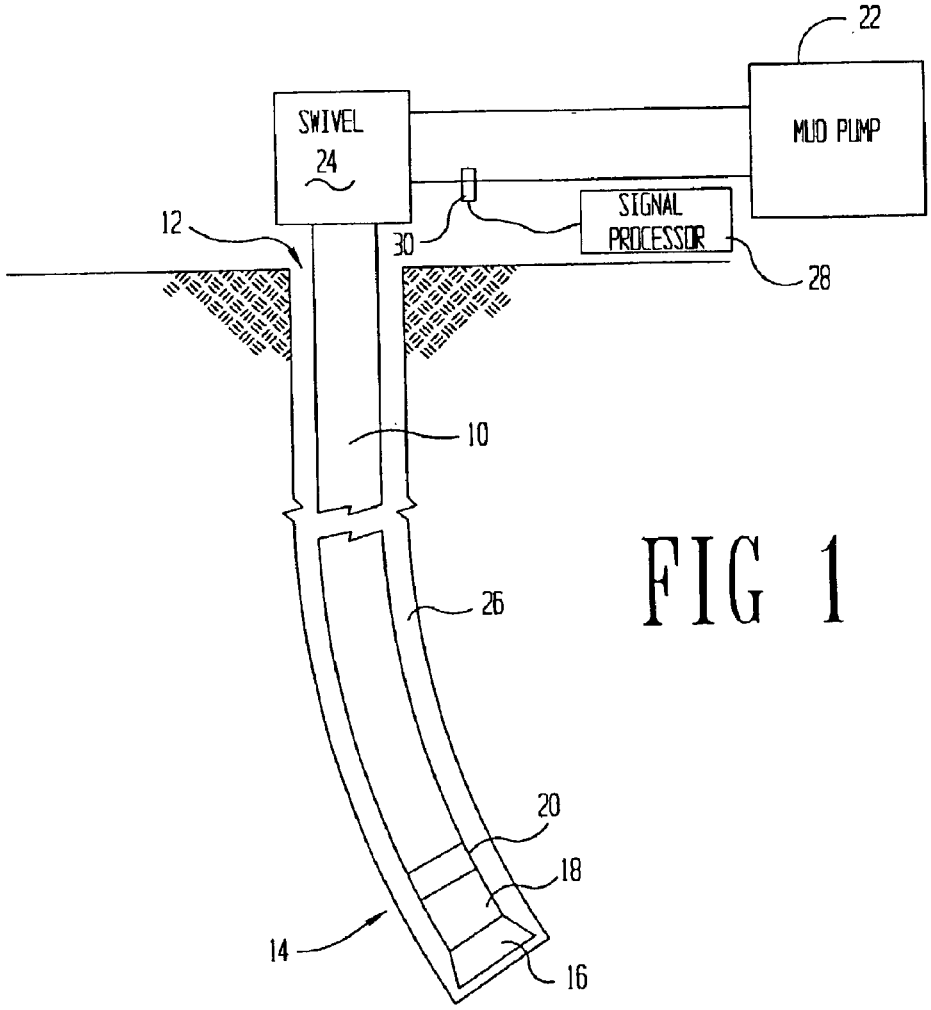
FIG. 1 shows an exemplary mud pulse telemetry system.

FIG. 1 shows an embodiment of a drilling system having a drill string 10 disposed within a borehole 12. The drill string 10 has at its lower end a bottomhole assembly 14 which may comprise a drill bit 16, downhole sensors 18, and a transmitter or pulser 20. The downhole sensors 18 may comprise any logging-while-drilling (LWD) or measuring-while-drilling (MWD) devices. The bottomhole assembly 14 may also comprise systems to facilitate deviated drilling such as a mud motor with bent housing, rotary steerable systems, and the like. Moreover, the lower end of the drill string 10 may also comprise drill collars (not specifically shown) to assist in maintaining the weight on the bit 16. Drill string 10 is preferably fluidly coupled to the mud pump 22 through a swivel 24. The swivel 24 allows the drilling fluid to be pumped into the drill string, even when the drill string is rotating as part of the drilling process. After passing through bit 16, or possibly bypassing bit 16 through pulser 20, the drilling fluid returns to the surface through the annulus 26. In alternative embodiments, the bottomhole assembly 14 may mechanically and fluidly couple to the surface by way of coiled tubing; however, the methods of detecting and correcting errors in the transmission of information from the bottomhole assembly to the surface described in this patent may remain unchanged.

Figure 2:
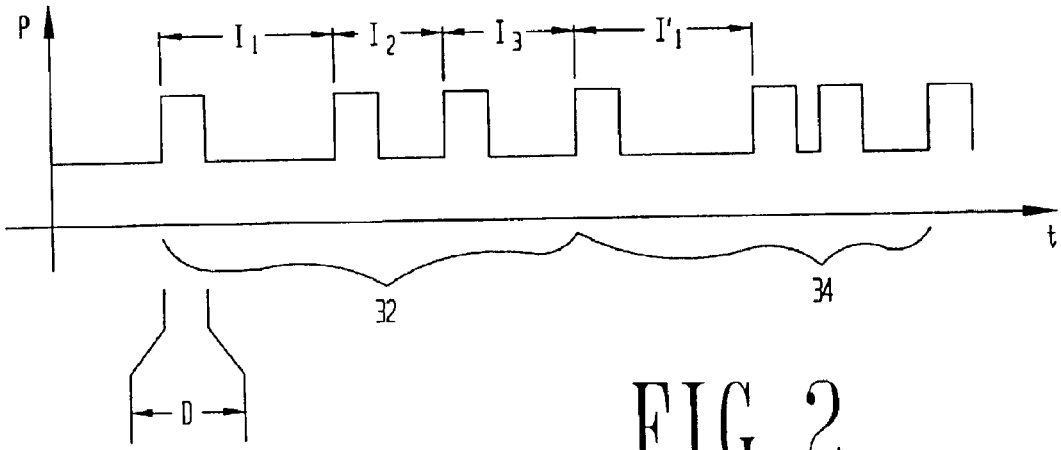
FIG. 2 shows an idealized graph of mud pulses generated in an exemplary system such as FIG. 1.

The various embodiments of the mud pulse telemetry system described in this patent preferably transmit data gathered by downhole sensors to the surface by inducing pressure pulses into the drilling fluid. More particularly, the preferred embodiments utilize a system where data is encoded in the amount of time between pressure pulses. FIG. 2 shows an exemplary graph of drilling fluid pressure as a function of time, which may be measured by the signal processor 28 coupled to the pressure sensing device 30 (FIG. 1). The exemplary graph of FIG. 2 represents an ideal situation where ideal square wave pulses are generated downhole, and are detected as ideal square waves at the surface. In actual systems, this may not be the case. FIG. 2 shows three intervals $I_1$. $I_2$ and $I_3$. In the preferred embodiments, an interval is the time duration between the leading (or alternatively trailing) edges of pulses.

Figure 3:
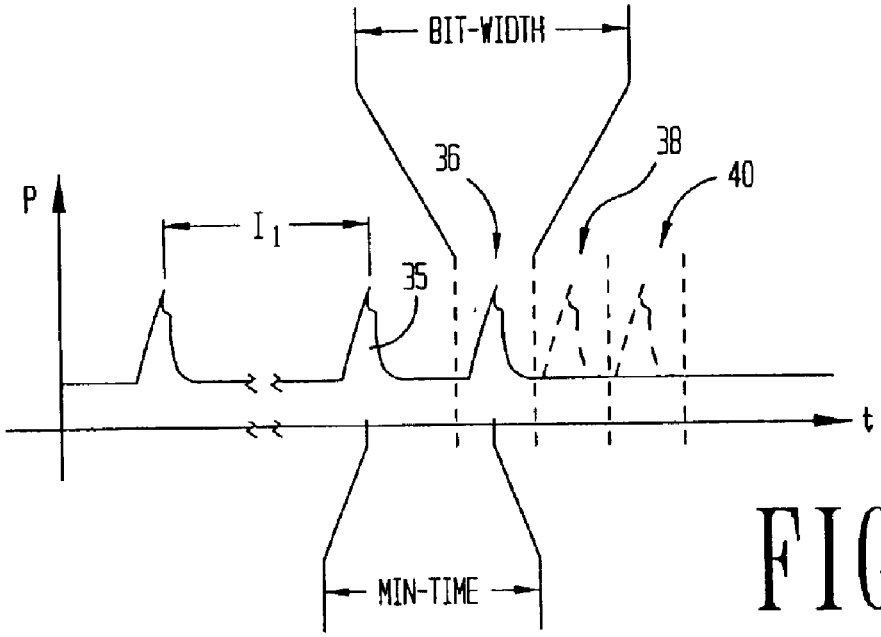
FIG. 3 shows a more realistic graph of pulses detected at the surface.

FIG. 3 shows a more realistic graph of pressure pulses that may be detected by the pressure sensor 30 and signal processor 28. Rather than being the ideal square wave pulses as depicted in FIG. 2, these pulses are dampened, have their frequency components dispersed, and the like. FIG. 3 also exemplifies several parameters of the pulse position modulation system of the preferred embodiments. In particular, interval $I_1$ is shown to have a particular time length or duration. The duration of the interval $I_1$ is preferably longer than a maximum interval length of the remaining intervals in each list so that the start of the new list may be identified. In alternative embodiments, a long interval may reside at the end of the list. For the intervals encoding data such as $I_2$ and $I_3$ (whether the encoded data is list ID or actual data gathered by downhole sensors 18), there is a minimum time (MIN-TIME) for the interval. An interval having a length substantially equal to the MIN-TIME encodes a data value zero. FIG. 3 exemplifies, in the second interval, two detected pulses that may represent a data value zero. The MIN-TIME duration may allow the drilling fluid column to settle after a pulse event (allows ringing and other noise in the drilling column to dampen out). The MIN-TIME may range from between approximately 0.3 seconds and 2.0 seconds for most drilling systems, with a MIN-TIME of 0.6 seconds preferred. The MIN-TIME duration may need to be greater than approximately three times a pulse duration, where the pulse duration is the time duration of a pulse event. A pulse event may be either a positive pulse or a negative pulse created by transmitter 20.

FIG. 3 also exemplifies that the interval duration need not necessarily be precise to represent a value. Instead, the preferred embodiments utilize a window in which a pulse of an interval may fall, yet still represent the same value. For the second interval of FIG. 3, the second pulse 36 may fall within the BIT-WIDTH window. So long as the second pulse 36 falls within the BIT-WIDTH window, the data value encoded may still be the same, in this particular example, a data value zero. The BIT-WIDTH window, however, is applicable to each received pulse in the pulse train. For example, the pulse 38 drawn in dashed lines falls within the next BIT-WIDTH window, and therefore the time duration between pulse 35 and pulse 38 may represent a data value one. Likewise, the pulse 40 falls within the third BIT-WIDTH window, and therefore the time duration between pulse 35 and pulse 40 may represent a data value two. The data value may be decoded using substantially the following equation:

$$\text{DATA}=\text{INTERVAL}-\text{MIN-TIME})/\text{BIT-WIDTH} \quad (1)$$

Wherein DATA is the decoded value, INTERVAL is the measured time of the interval, and MIN-TIME and BIT-WIDTH are as described above. Given existing technology, BIT-WIDTH values may range from approximately 0.03 seconds to 0.12 seconds; however, a BIT-WIDTH value of 0.04 seconds is preferred. For a particular number of bits encoded within each interval, there is a maximum time (MAX-TIME) length or duration. For example, if a particular interval encodes a four-bit number (which could therefore range from zero to fifteen), the four-bit number at its maximum value forces an interval duration equal to its MAX-TIME.

Drilling fluid within a drill string during the drilling process is an extremely noisy environment for data transmission. Pressure pulses imparted to the drilling fluid by way of the transmitter or pulser 20 see significant attenuation and frequency component shifts as they propagate to the surface. The preferred embodiments are directed to detecting and correcting data transmission errors which may be caused by noise in the drilling process. The inventors have discovered that there may be at least five events which lead to errors in decoding information encoded in pulse position modulation system. These cases are: 1) "Miss greater than maximum"; 2) "Miss less than maximum"; 3) extra pulse; 4) shifted pulse; and 5) off by a value of one. The "Miss greater than maximum" case represents a situation where a valid pulse is not detected, resulting in an interval whose duration is greater than the maximum defined for that interval (longer than a synchronizing interval, or longer than a data interval). Thus, in the "Miss greater than maximum" case, the interval duration is greater than would be expected, even if the encoded data was at a maximum value. The "Miss less than maximum" case represents a situation where a true pulse is not detected, but the resulting interval duration is still less than the maximum defined for that interval. This could happen, for example, where two intervals are transmitted from downhole, their shared pulse is not detected, but the combined interval is still less than the maximum duration. The "Extra pulse" case may occur where an erroneous pulse is detected between two valid pulses.

In addition to pulses that were actually sent not being detected and additional unsent pulses being detected, due to the dynamics of a drilling system it is possible for pulses to shift in time relative to each other as they propagate in the drilling fluid. This may lead to the shifted case where one data value for an interval is reduced by one, while the next data value is increased by one. Relatedly, it is possible for a particular interval to have data value that is off by one, but where prior or subsequent intervals still contain valid data.

The preferred embodiments group intervals into lists, for example list 32 or list 34 in FIG. 2. Each list may comprise detected downhole parameters such as electromagnetic wave resistivity (an eight-bit value encoded in two intervals), a gamma ray reading (an eight-bit value encoded in two intervals), and a density value (a twelve bit value encoded in three intervals). Multiple lists may be created. Moreover, in a continuous operation mode, the downhole device may cyclically transmit the various lists, and therefore repeatedly send data values contained in those lists. The following table exemplifies the components of a group of intervals from a particular list.

TABLE 1

| | Bit Number | | | | | | | |
|---|---|---|---|---|---|---|---|---|
| Interval | 7 | 6 | 5 | 4 | 3 | 2 | 1 | 0 |
| 1 | PAD 2 | PAD 1 | PAD 0 | P 4 | P 3 | P 2 | P 1 | P 0 |
| 2 | 0 | 0 | 0 | 0 | ID 3 | ID 2 | ID 1 | ID 0 |
| 3 | 0 | 0 | 0 | 0 | A 7 | A 5 | A 3 | A 1 |
| 4 | 0 | 0 | 0 | 0 | A 6 | A 4 | A 2 | A 0 |
| 5 | 0 | 0 | 0 | 0 | B 7 | B 5 | B 3 | B 1 |
| 6 | 0 | 0 | 0 | 0 | B 6 | B 4 | B 2 | B 0 |
| 7 | 0 | 0 | 0 | 0 | C 3 | C 2 | C 1 | C 0 |
| 8 | 0 | 0 | 0 | 0 | C 7 | C 6 | C 5 | C 4 |
| 9 | 0 | 0 | 0 | 0 | C 11 | C 10 | C 9 | C 8 |

In Table 1 (PAD 2 . . . PAD 0) are pad bits in the long interval, that identifies the start of a new list, (P4 . . . P0) are parity bits calculated using the encoded data contained in the list, (ID3 . . . D0) are identification bits which identify the list, (A7 . . . A0) are bits of an eight bit downhole parameter, (B7 . . . B0) are bits of an eight bit downhole parameter, and (C11 . . . C0) are the bits of a twelve bit downhole parameter. Table 1 exemplifies that in the preferred embodiment, except for the initial interval, the intervals in a list have encoded therein a number of bits that is less than the number of parity bits, and may be the same for each interval. The number of bits in each data interval may be selected to increase efficiency of the transmission time given a particular BIT-WIDTH and MIN-TIME. For most applications, intervals using four bit encoding are preferred, even if the data itself requires a greater number of bits. Co-pending application Ser. No. 10/306,487 titled "Structure and Method for Pulse Telemetry," which is incorporated by reference herein as if reproduced in full below, describes efficient data transfers. Table 1 shows only the transfer of three pieces of data (two eight bit parameters and a twelve bit parameter); however, any number of parameters may be transferred within any one list.

The embodiments of the invention have the capability to define multiple lists, and then send the lists uphole. During normal operation, a "continuous" series of lists may be sent. For example, consider a system that has defined a total of five lists ($L_1$, $L_2$ . . . $L_5$), and further consider that the bottomhole assembly 14 is programmed in a continuous mode to send lists in the following order: $L_1$, $L_2$, $L_3$, $L_5$. In normal operation, the bottomhole assembly transmits the lists cyclically such that two complete transmissions of the defined list may appear as: $L_1$, $L_2$, $L_3$, $L_5$, $L_1$, $L_2$, $L_3$, $L_5$. Further, the various embodiments may define intermittent lists, for example list $L_4$, which are sent uphole intermittently. Thus, a "continuous" list may be momentarily interrupted by an intermittent list. The following sequence of list transmissions may occur: $L_1$, $L_2$, $L_3$, $L_5$, $L_4$, $L_1$, $L_2$, $L_3$, . . . . Finally, the bottomhole assembly of the preferred embodiments may also have another set of lists that are transmitted uphole during start-up operations. The signal processor 28 is aware of the contents of the various lists, as well as the expected order that the continuous lists should be received. As will be discussed more fully below, part of the adaptive algorithm for detecting and correcting errors may utilize this knowledge.

Figure 4:
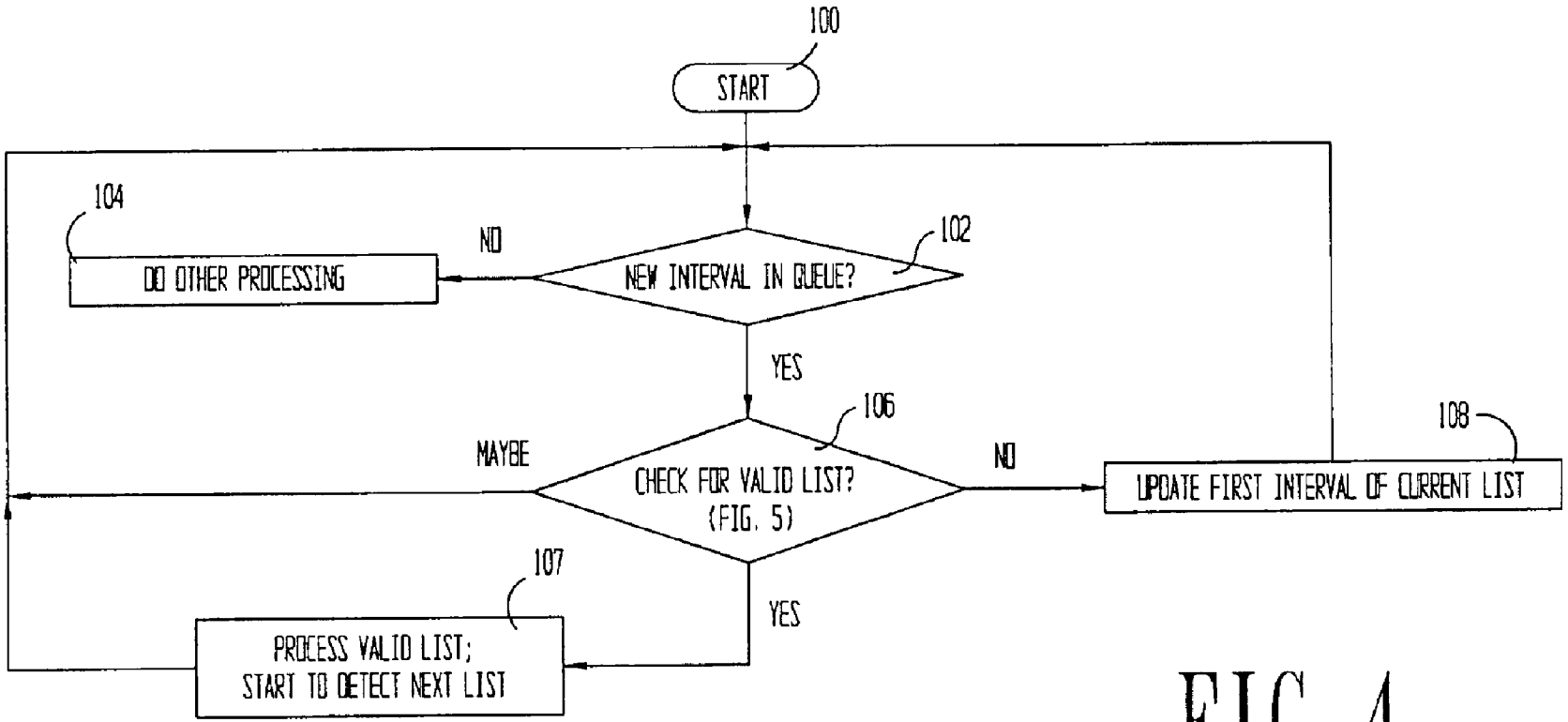
FIG. 4 shows an exemplary flow diagram for the overall processing of the embodiments of the invention.

FIG. 4 illustrates a flow diagram for the main algorithm for processing each list. In particular, the process starts at block 100 and is followed by a determination as to whether a new interval has been received into an interval queue (block 102). If no additional intervals have been received, the processor may perform other processing duties (block 104). If, however, a new interval has been placed in the interval queue, the system preferably determines whether this new interval is part of a valid list (by calling an algorithm such as exemplified in FIG. 5) (block 106). If the list is valid, the valid list is processed and the next interval is considered the first interval of the next list (block 107). If the algorithm was not able to detect a valid list with the current set of intervals (possibly it does not have all the intervals necessary to decode the list, corresponding to MAYBE case returned from block 106), the process preferably waits until new intervals are received before trying to process the current list again. If the algorithm already has enough intervals, but was not able to decode a valid list, the first interval may be considered a bad interval, and the interval that follows it may be used as a possible first interval (block 108).

Figure 5:
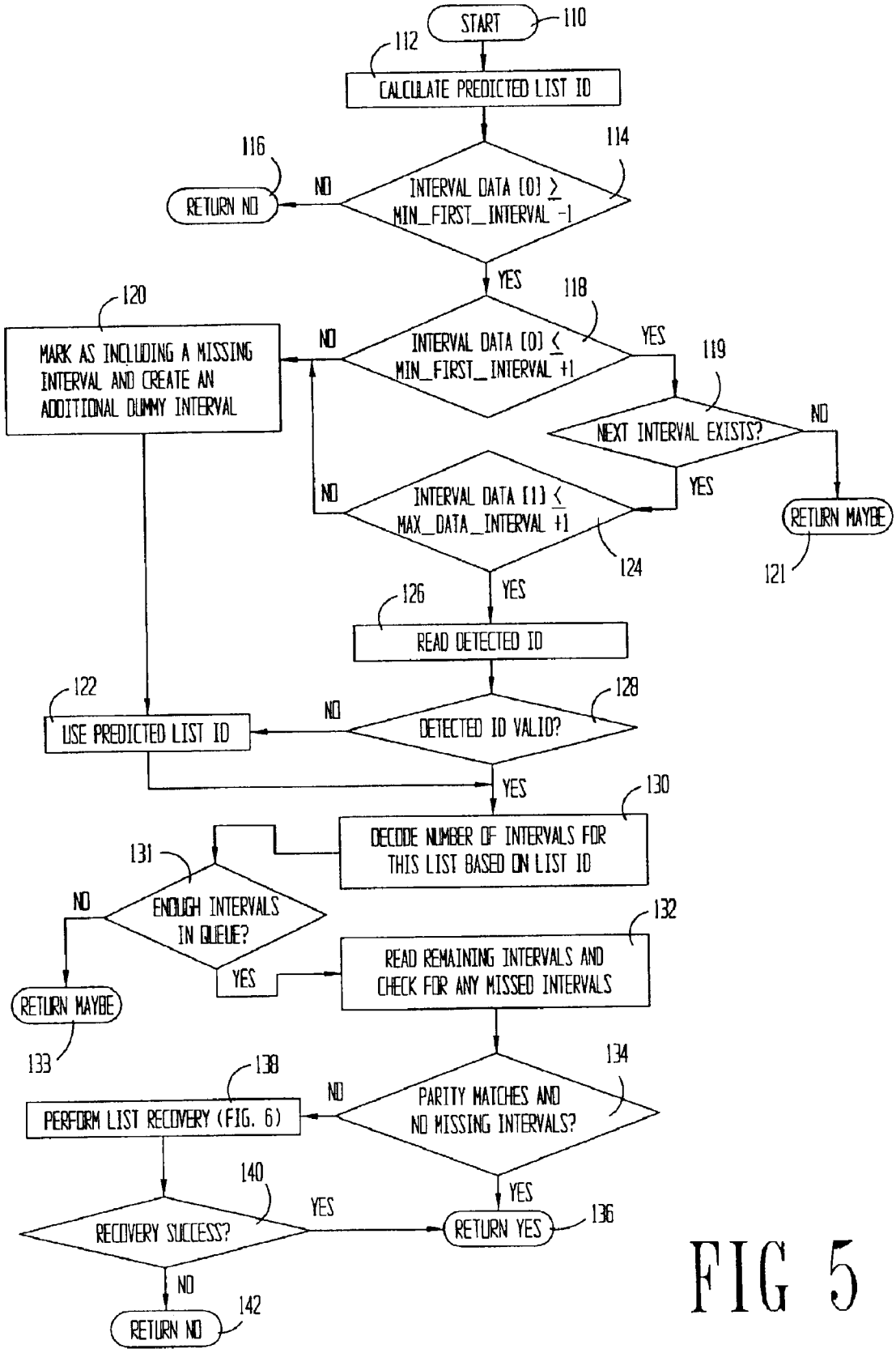
FIG. 5 shows an exemplary flow diagram for determining if a series of intervals are a valid list.

FIG. 5 shows a flow diagram of an algorithm used to determine whether a list is valid. The process starts at block 110 and proceeds to a calculation of a predicted list ID (block 112). The identification numbers of the previous detected lists are stored. The algorithm looks at the identification number of the previous list detected. If the identification number for the previous list was that of an intermittent list (as opposed to one of the list numbers in the continuous list), then the algorithm skips the intermittent list and examines the previous list. This process is repeated until the algorithm finds a list identification number that is part of the continuous list. When a list identification number is found that is part of the continuous list, the identification number is compared with the sequence list that contains the list identifications that are being pulsed in the continuous mode. By looking at the sequence list, the algorithm preferably predicts the next list number for the sequence. For example, the continuous lists described were $L_1$, $L_2$, $L_3$, and $L_5$, and $L_4$ was part of an intermittent list. The following sequence of list transmissions may occur: $L_1$, $L_2$, $L_3$, $L_4$, $L_5$, $L_1$, $L_2$, $L_3$, . . . . If the algorithm successfully detected list $L_1$ as the previous list, the predicted list identification would be $L_2$. If the algorithm successfully detected list $L_4$ as the previous list, $L_4$ is ignored as it is part of an intermittent list, and the algorithm looks further to determine that $L_3$ was the previous list in the continuous category. Thus, in this example the algorithm predicts that $L_5$ should be the next list. As an additional example, consider a continuous list defined as $L_1$, $L_2$, $L_1$, $L_3$, $L_5$, and $L_4$ again being an intermittent list. Suppose the bottomhole assembly transmits the following sequence: $L_1$, $L_2$, $L_1$, $L_4$, $L_4$. In predicting a list identification for a list following the second $L_4$ list, the list predicting algorithm may ignore the set of $L_4$ lists and observe the $L_1$ list. However, because the $L_1$ list precedes, in this example, both an $L_2$ list and a $L_3$ list, finding the last continuous entry may not suffice to accurately predict the next list. The predictive algorithm of the preferred embodiments may look back at a plurality of the lists in order to predict a next list. In the example above, the predictive algorithm may need to look back to the $L_2$ list to predict that $L_3$ should be the next list (rather than $L_2$).

Returning to the flow diagram of FIG. 5, after calculating the predicted list identification (block 112), the process determines whether the data value for the first interval (synchronizing interval) is greater than the minimum data value for the first interval (MIN_FIRST_INTERVAL) (block 114). If the interval data value is less than the MIN_FIRST_INTERVAL−1, the interval cannot represent the start of a new list, and the process returns (block 116). If the synchronizing interval data value is greater than or equal to the MWN_FIRST_INTERVAL−1, the process moves to a determination of whether the interval data value is less than or equal to the maximum synchronizing interval data value (MAX_FIRST_INTERVAL) plus one (block 118). If the synchronizing interval data value is between or equal to the MIN_FIRST_INTERVAL−1 and the MAX_FIRST_INTERVAL+1, the interval identifies a new list. An interval data value greater than the MAX_FIRST_INTERVAL+1 is indicative of a missed pulse. The preferred embodiments mark the interval as possibly missing a pulse, and create an additional dummy interval (block 120). In this case, the algorithm uses a predicted list identification (block 122), and continues processing as exemplified by block 130 (discussed more fully below).

If the parameter checking reveals the first interval in the queue does indeed identify the beginning of a new list, preferably the next step is to determine whether the second interval in the queue is received (block 119). If it is not received, algorithm preferably returns MAYBE to wait for more intervals (block 121). If the next interval is received, algorithm preferably determines whether the second interval in the queue is less than the maximum data value defined for that interval (MAX_DATA_INTERVAL) plus one (block 124). If the data of the second interval in the queue is greater than MAX_DATA_INTERVAL+1, this too is indicative of a missed pulse, and processing preferably continues as a missed pulse case (blocks 120 and 122). On the other hand, if the data of the second interval is less than MAX_DATA_INTERVAL+1, this is indicative of a valid second interval, which according to the preferred embodiment comprises the list identification (see Table 1). Thus, the next step may be to read the detected list identification numbers (block 126) and determine whether the detected identification number is valid. The detected identification number should either match the predicted identification number or be a predefined intermittent list (block 128). If the identification number detected is not valid, the process uses the predicted identification number as the identification number (block 122). The algorithm decodes the number of intervals expected for the particular list based on the identification number determined (block 130). The algorithm preferably checks to see if enough intervals have been received (block 131). If number of intervals received are not sufficient, algorithm returns MAYBE to wait for more intervals (block 133). If enough intervals are received, the algorithm reads the remaining intervals (block 132).

After receiving what is believed to be the correct number of intervals for the decoded or predicted list identification, the algorithm determines whether the parity values calculated for the data match those sent in the interval that contains parity value transmitted, in this case, the initial interval (see Table 1) (block 134). The co-pending application incorporated by reference above discusses calculating parity of the preferred embodiments. If parity matches and there are no intervals tagged as possibly containing missing pulses (see block 120), the algorithm returns to its calling function and indicates a valid list is identified (block 136). If parity does not match or there are intervals tagged as possibly containing missing pulses (or both), then the system preferably performs list recovery by calling an algorithm such as that exemplified in FIG. 6 (block 138). If the list is successfully recovered as determined by block 140, the process ends indicating a valid list is identified (block 136). If recovery was not successful, the process returns indicating an error (block 142).

Figure 6:
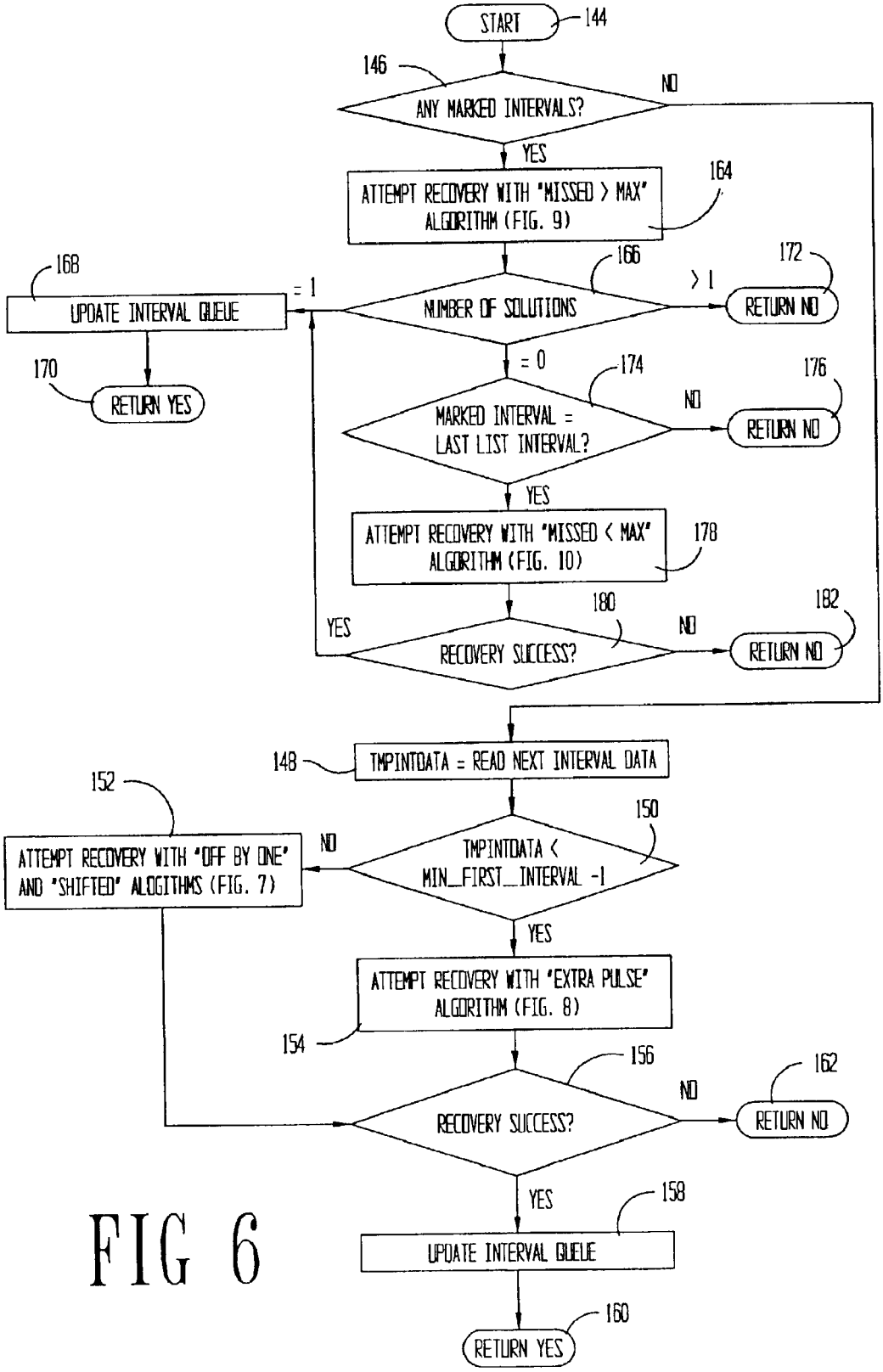
FIG. 6 shows an exemplary flow diagram for processing in the case where errors have occurred.

FIG. 6 illustrates a flow diagram for implementation of some of the list recovery functions. In particular, the process starts (block 144) and proceeds to a determination of whether the list under examination contains intervals tagged as possibly containing missed pulses (block 146). If there are no intervals tagged (indicating a parity match precipitated calling of the algorithm), the preferred process checks the "Off by one," "Shifted" and "Extra pulse" error theory cases.

Figure 7:
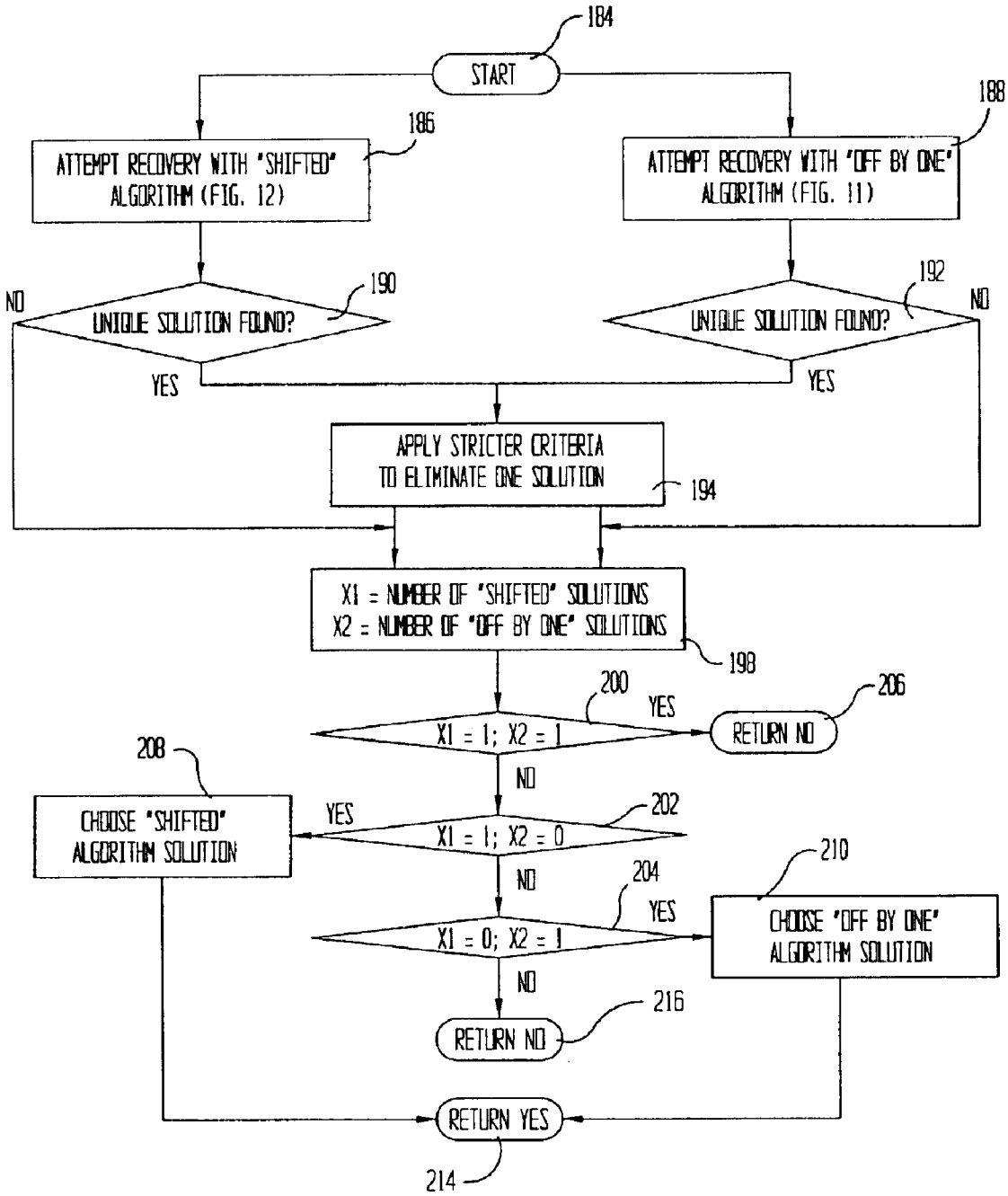
FIG. 7 shows an exemplary flow diagram of the somewhat simultaneous application of the "Shifted" and "Off by one" error case.
Figure 8:
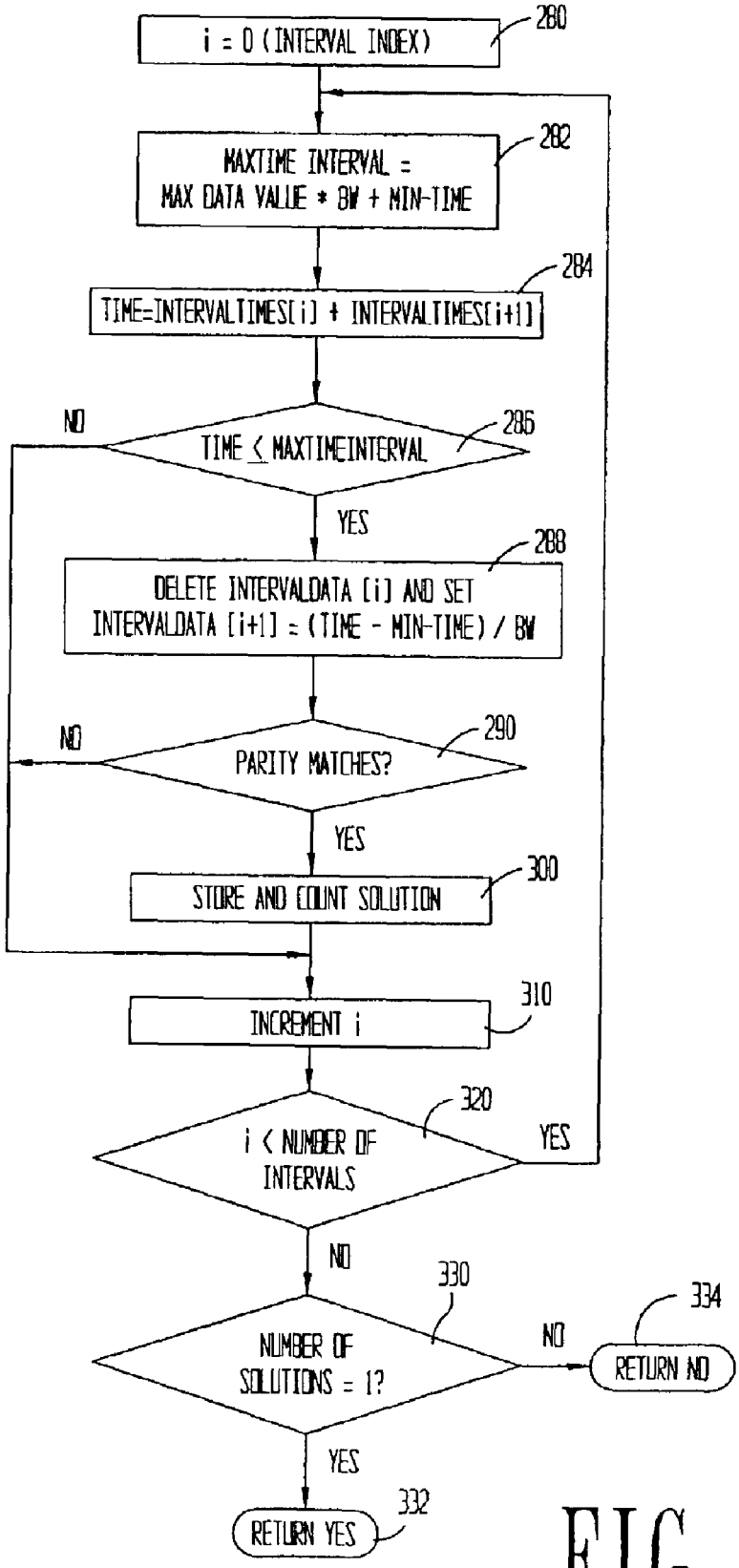
FIG. 8 shows an exemplary flow diagram for the "Extra pulse" error case.

In this second case, the data value for the next interval is preferably read, and delineated as a temporary interval data (TmpIntData) (block 148). The algorithm determines if the TmpIntData is less than the MIN_FIRST_INTERVAL−1 (block 150). If the interval is less than the MIN_FIRST_INTERVAL−1, this is an indication that an end of list has not been reached and there is likely an extra pulse that needs to be eliminated, and in this situation the algorithm calls an algorithm which attempts a recovery (the algorithm as shown in FIG. 8, discussed below) (block 154). If the TmpIntData is not less than the MIN_FIRST_INTERVAL−1, indicating end of list is reached, the algorithm exemplified in FIG. 6 assumes that the error may be one of the cases where data values change because of pulses shifting and therefore "Off by one" and "Shifted" algorithms are attempted(whose flow diagram is exemplified in FIG. 7 discussed below) (block 152). If the list was recovered by one of the attempted recovery mechanisms (block 156), the algorithm updates the interval queue with the corrected data (block 158) and the process returns (block 160). If none of the attempted recovery mechanisms recovers the list (block 156), then the error cannot be corrected and the process returns indicating an inability to recover (block 162).

Still referring to FIG. 6, if the algorithm finds intervals marked or tagged as possibly having a missed pulse (block 146), then the error may be a "Miss greater than maximum" error, and the process calls an algorithm such as that exemplified in FIG. 9 (discussed below) (block 164). If the "Miss greater than maximum" algorithm returns a single unique solution (block 166), the interval is updated in the queue (block 168) and the process returns (block 170). If, however, the "Miss greater than maximum" algorithm finds more than one unique solution (block 166), the process returns indicating an inability to recover (block 172).

If no solutions were found (block 164, 166), the algorithm determines if the tagged interval is the last interval of a list (block 174). Because of the missed pulse, the first interval of the next list is most likely marked as bad (given that the system was expecting a short interval as the last interval in the list, and instead received a long interval indicating the start of the next list). If the tagged interval is not the last interval, then the process returns, indicating that the error cannot be recovered (block 176). If, the tagged interval does appear to be the last interval, then the algorithm attempts error recovery using the "Miss less than maximum" process (block 178), which process is exemplified in FIG. 10, discussed below. If the process exemplified in FIG. 6 determines that the "Miss less than maximum" algorithm was successful (block 180), then the interval is updated in the queue (block 168) and the process returns an indication that the error was corrected (block 170). If it is determined that there is no solution (block 180), the process returns a negative indication (block 182).

It is possible a pulse shift due to noise changes the value of two intervals, or changes the value of only a single interval. The algorithm exemplified by the flow diagram of FIG. 7 (which is called by the algorithm exemplified in the flow diagram of FIG. 6) attempts to make a determination which of these two possibilities has occurred in any particular situation. In particular, the process starts at block 184 and may proceed simultaneously to attempting recovery using the "Shifted" error theory algorithm (the process of which is exemplified in the flow diagram of FIG. 12) (block 186) and using the "Off by one" error theory algorithm (whose flow diagram is exemplified in FIG. 11) (block 188). Each of these error theory recovery techniques may or may not result in a single unique solution. If both processes reveal one solution (blocks 190 and 192), then the process attempts to eliminate one solution (block 194). The criteria are discussed with respect to FIGS. 11, 11A and 12, in particular with reference to block 346 (of FIG. 11), FIG. 11A and block 378 (of FIG. 12). The solutions are compared (blocks 198, 200, 202 and 204). If each error theory recovery algorithm determines a unique solution (in spite of the attempt to eliminate one solution (block 194)), then the process returns indicating an inability to recover (block 206). If one error theory recovery algorithm finds a unique solution and the second does not, the solution is applied (blocks 208 or 210, and 214). Finally, if no solutions were found, the process returns a negative indication (block 216).

Figure 9:
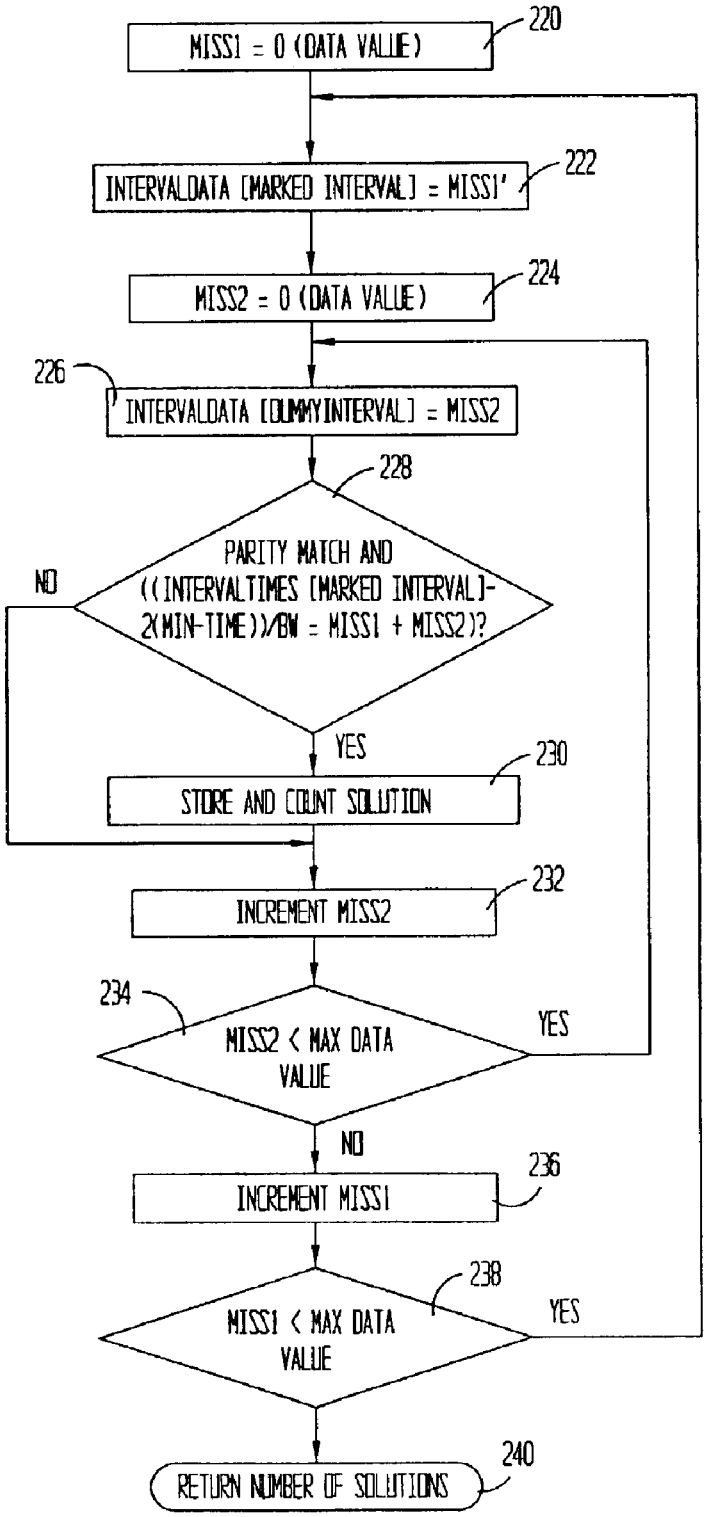
FIG. 9 shows an exemplary flow diagram used in both the "Missed greater than maximum" and "Missed less than maximum" error cases.

FIG. 9 illustrates a flow diagram of the algorithm used to attempt to find solutions when an interval detected is greater than the maximum allowed for that interval—the "Miss greater than maximum case." As was discussed with respect to FIG. 5, when an interval is determined to be longer than expected (whether a synchronizing interval or a data interval), the interval is marked or tagged, and the algorithm additionally inserts a dummy interval, possibly immediately thereafter (block 120 of FIG. 5). This situation arises when the detection algorithm misses a pulse, either due to its reduced pulse amplitude or distortion of its shape due to noise. The "Miss greater than maximum" error theory recovery algorithm of FIG. 9 tries all combinations of interval data values (starting from zero and extending to the maximum allowable value) for both the tagged and dummy intervals. In summary, for each possible data combination, the algorithm checks if the sum of the data combination is equal to the data value corresponding to the tagged interval. If the data values are equal, the algorithm then checks to see if the proposed solution matches the parity for that list. If there is only one successful match between the calculated parity and the detected parity, the algorithm successfully recovers the current list.

Thus, the first step in the process is zeroing a first value (Miss1) (block 220). Thereafter, the interval data value at the marked or tagged interval is set equal to Miss1 (zero initially) (block 222). Next, a second variable (Miss2) is cleared to zero (block 224), and the dummy interval data is set equal to the value of Miss2 (zero initially) (block 226). The algorithm illustrated in FIG. 9 next preferably determines whether the data value of the marked or tagged interval is equal to the sum of the data values of the test solutions, and if the parity matches (block 228). If the sum of the data values of the test solutions equals the data value of the marked interval, and if a parity calculated using the data matches parity transmitted, the Miss1 and Miss2 data values represent a solution, which are stored and a counter incremented (block 230). Whether or not a solution is found, the second variable Miss2 is preferably incremented (block 232), and a determination is made as to whether this second variable exceeds a maximum data value (block 234). The maximum data value at block 234 is dependent upon whether the marked interval is suspected to be the synchronizing interval or a data interval. If it is suspected to be a synchronizing interval, the maximum data value would be equal to the MAX_FIRST_INTERVAL. Otherwise, the maximum data value would be equal to the MAX_DATA_INTERVAL. So long as the Miss2 variable is less than the maximum data value, blocks 226, 228, 230 and 232 repeat using the same Miss1 value. The overall process repeats for each Miss1 variable value (blocks 236 and 238) up to maximum data value. After having tested each possible combination, the algorithm returns the number of solutions (block 240) which is used by block 164 (in FIG. 6) to determine if the algorithm was successful in recovering the list.

Figure 10:
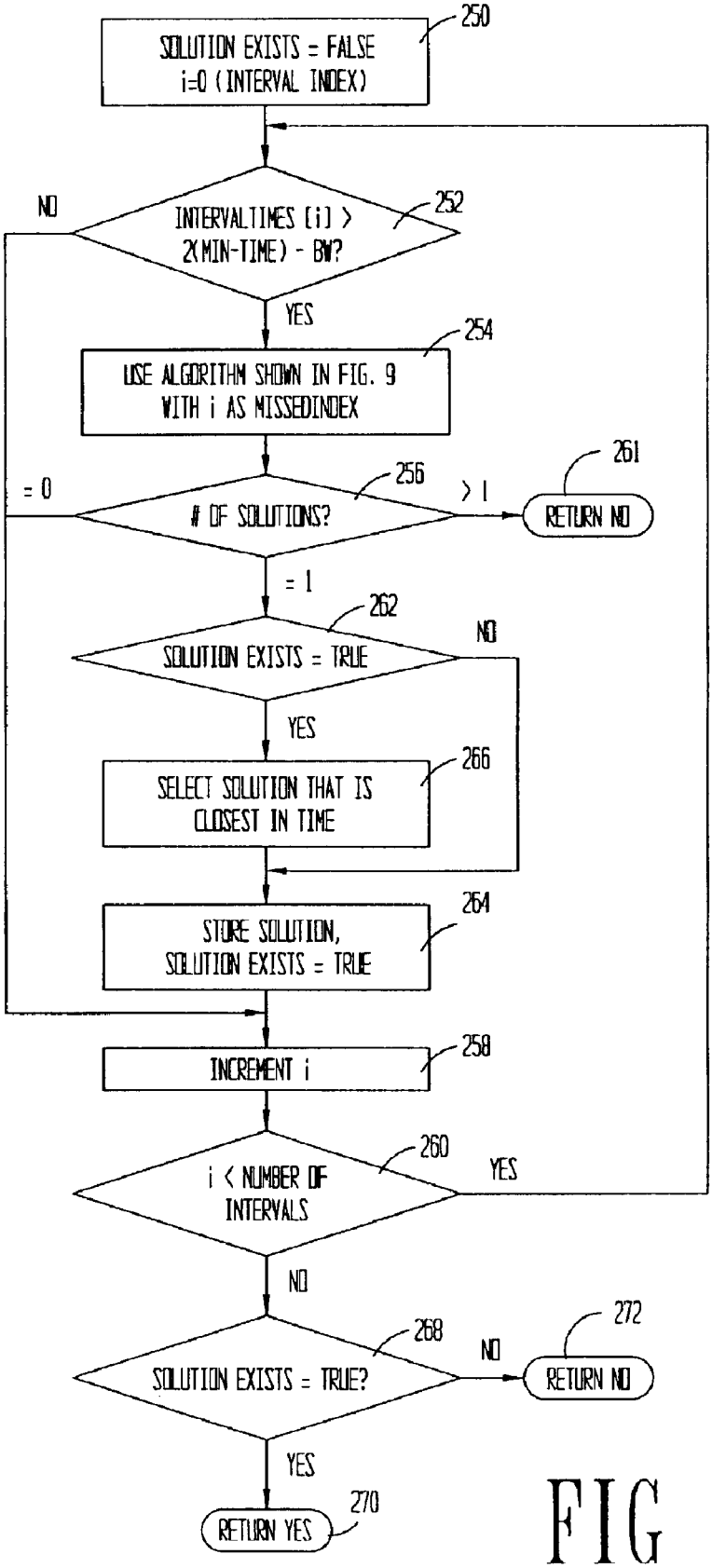
FIG. 10 shows an exemplary implementing the "Missed less than maximum" error case.

FIG. 10 shows an exemplary algorithm for the "Miss less than maximum" error theory case. This situation arises when the detection algorithm misses a pulse, yet the resulting interval is less than the predetermined maximum allowable for that interval. Since each interval in the list is less than the maximum predetermined value, the algorithm does not know which interval is bad, and therefore considers each interval as possibly having a missing pulse. Moreover, because of the missed pulse, the first interval of the next list is most likely marked as bad (given that the system was expecting a short interval as the last interval in the list, and instead received a long interval indicating the start of the next list).

For a "Miss less than maximum" error theory case, illustrated in FIG. 10, the time duration of the bad interval should be at least twice the MIN-TIME. That is, if a pulse was missed, each of the two intervals (now combined because of the missing pulse) contained a minimum time. As a threshold inquiry then, all the intervals whose time durations are less than twice the MIN-TIME minus a BIT-WIDTH are eliminated as suspects (blocks 250 and 252). For each interval having a time duration greater than two times the MIN-TIME minus a BIT-WIDTH, this algorithm inserts a dummy interval and calls the algorithm illustrated in FIG. 9, originally discussed with respect to detecting and correcting errors in the "Miss greater than maximum" error theory case. However, rather than the algorithm illustrated in FIG. 9 operating on a tagged or marked interval, the algorithm illustrated in FIG. 10 directs the algorithm illustrated in FIG. 9 to perform the task on the interval that meets the two times the MIN-TIME minus a BIT-WIDTH criteria (block 254) (and a dummy interval). If no solution is found (block 256), the process increments the variable (block 258), checks to make sure that the variable number does not exceed the number of intervals for this list (block 260), and if not, repeats the process for additional intervals in the list that meet the two times MIN-TIME minus a BIT-WIDTH criteria. If any particular use of the algorithm illustrated in FIG. 9 results in multiple solutions (block 256), the algorithm returns with a negative indication (block 261) indicating that the list could not be recovered. If only one solution is found, a determination is made as to whether there already exists a solution based on one of the previous intervals (block 262). If a solution does not already exist, the algorithm stores this solution and marks that a solution exists (block 264). If a solution already exists, the algorithm compares the existing solution with the current solution and selects the solution that gives a total interval time as close as possible to the interval tested (block 266). The chosen solution is then stored (block 264). Finally, if the algorithm illustrated in FIG. 10 determines that a solution was recorded (block 268), it returns a positive indication (block 270); otherwise, it returns a negative indication (block 272).

FIG. 8 shows an exemplary flow diagram for an algorithm for the "Extra pulse" error theory case. This situation arises when the detection algorithm detects an extra pulse in an interval, which may result in one good interval becoming two bad intervals. The first step in the process may be zeroing a first interval index value (block 280). Next, the preferred algorithm may determine a maximum time duration for a single interval (being the maximum data value multiplied with the BIT-WIDTH and adding the MIN-TIME) (block 282). It is noted that the maximum data value will be larger if the interval under inspection corresponds to the synchronizing interval in a list. Next, the algorithm adds the interval duration for the interval identified by the interval index variable, and the subsequent interval. If the total time of these intervals exceeds the maximum time interval (MAX FIRST_INTERVAL or MAX_DATA_INTERVAL), then the extra pulse cannot be the pulse between these two intervals and the process increments to the next set (block 286). If the calculated time is less than or equal to the maximum time interval, the algorithm of FIG. 8 temporarily removes the shared pulse, calculates or decodes the data indicated by the combined interval durations (block 288) and makes a determination as to whether the parity matches (block 290). If the parity matches, the process stores the solution and increments counter (block 300). The interval index variable is incremented (block 310), checked to make sure that the interval index variable does not exceed the total number of intervals in the list (block 320), and the process repeated. As soon as each combination of intervals in the list has been tested, the algorithm determines the number of solutions found (block 330). If only one solution is found, the algorithm returns a positive indication (block 332), and a negative indication if no solution or more than one solution was found (block 334).

Figure 11A:
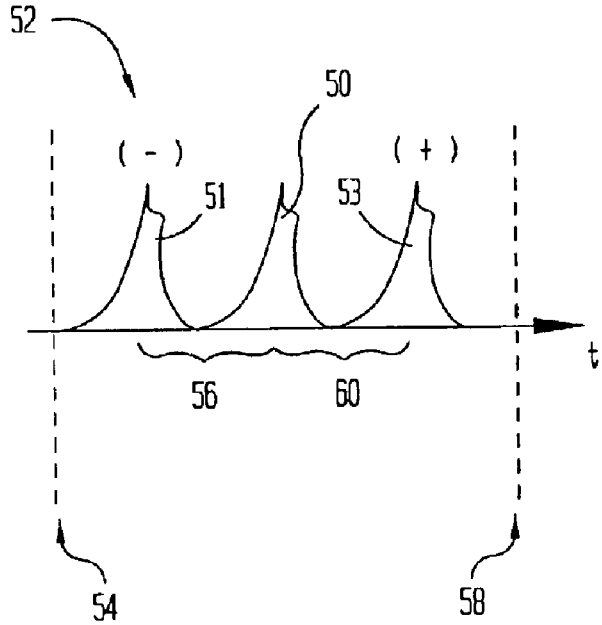
FIG. 11A shows an exemplary BIT-WIDTH window for the purpose of explaining remainders for solution selection criteria.
Figure 11:
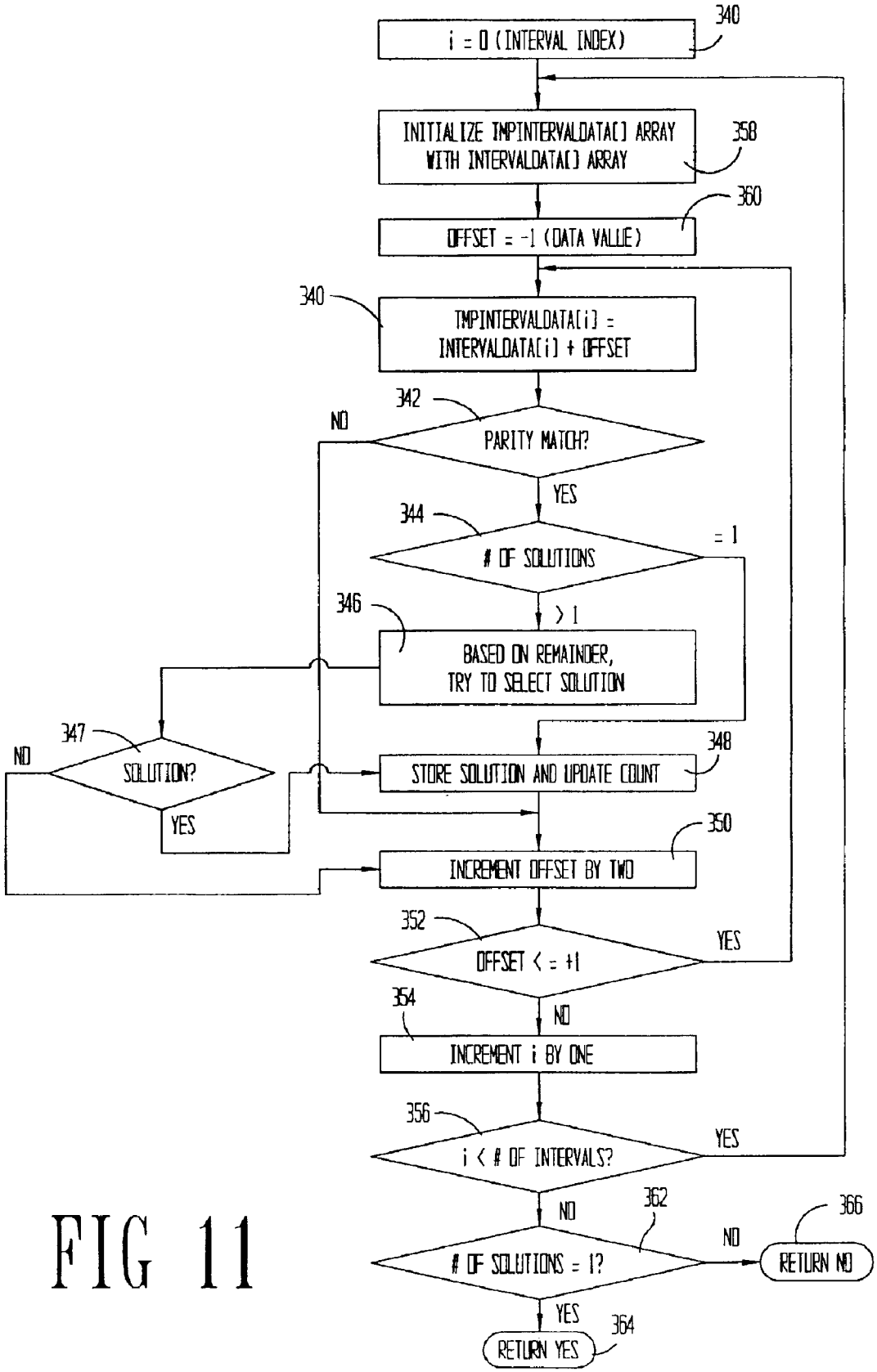
FIG. 11 shows an exemplary flow diagram for the "Off by one" error case.

FIG. 11 shows an exemplary flow diagram for an algorithm for the "Off by one" error theory case. This algorithm is directed to the situation where, because of jitter of pulses in the pulse train, one of the intervals is shifted in such a way that the data value only for that interval is incorrect or invalid, while the previous or following interval can still have the correct data. In summary, the algorithm exemplified in FIG. 11 operates by increasing and decreasing each interval data value by one (without changing the value of the preceding or following intervals). For each increase and decrease, the algorithm checks parity. If there are multiple solutions, the algorithm attempts to select one of the solutions. The attempted selection is based on where a pulse falls within a BIT-WIDTH window. FIG. 11A illustrates a BIT-WIDTH window 52. In ideal situations, the pulse would be detected precisely in the center of the window, such as pulse 50. If a pulse 51 is detected within the window, but closer to the leading boundary 54, the data value decoded may be the same, but there is a remainder 56 between the detected pulse and the ideal case. These remainders can have a value from (−1*BIT-WDTH/2) to 0. In the leading case, the remainder may be considered negative. Likewise, if a pulse 53 is detected within the window, but closer to the trailing boundary 58, the remainder 60 may be considered positive. These remainders can have a value from 0 to (BIT-WDTH/2). Thus, the remainders 56, 60 are time values. However, if a pulse is detected outside the window and, for instance, closer to the trailing boundary 58, this would result in a data value which is one more than the true data value. This will also result in a large negative remainder. Similarly, if the pulse is detected outside the window but closer to the leading boundary 54, this would result in a data value which is one less than the true data value. This would also result in a large positive remainder.

In situations where multiple possible solutions are found, embodiments of the invention attempt to select a solution based on the remainders. In particular, in the "Off by one" case, solutions where the absolute value of the remainder of the interval being tested is greater than approximately a quarter of the BIT-WIDTH are considered likely candidates. It is noted that adding of the offset is applied to a decoded data value, rather than shifting pulse arrival time. Thus, if a data value is increased (or decreased), and the increased (or decreased) value appears to be a solution, an interval with a remainder greater than a quarter of a bit width (close to a BIT-WIDTH window boundary), may likely be a correct solution.

Returning to the exemplary flow diagram of FIG. 11, the first step in the algorithm is setting an interval index variable to zero (block 340). Thereafter, a temporary interval data array (TmpIntervalData) is initialized using the interval data values (block 358). An offset is set to negative one (block 360) and the temporary interval data at the current interval index variable has added thereto the offset value (block 340). Using the interval data with the offset added thereto, the algorithm preferably determines if parity matches (block 342). If there is a parity match, the algorithm preferably determines the number of solutions found at that point (block 344). If this is the first solution found, the algorithm preferably stores the solution and updates the solution counter to be one (block 348). If more than one solution exists, the algorithm preferably tries to select a solution based on the remainders, as discussed above (block 346). If one or more solutions exist (block 347), the algorithm preferably stores the solution(s) and updates the solution counter to be number of solutions that satisfy the criteria (block 348). After storing and updating the counter, or if the parity does not match (block 347), the algorithm preferably increments the offset by two (making the offset a positive one) (block 350), and checks to see if the offset is greater than positive one (block 352). If the offset is not greater than positive one, the algorithm performs the steps exemplified by blocks 340, 342, 344, 346, 348 and 350 again. If, however, the offset is greater than one (indicating that both the negative and positive cases have been assessed), the algorithm preferably increments the interval index variable (block 354), and checks to see if the interval index variable is greater than the number of intervals in the current list (block 356). If there are further intervals to check, the process preferably begins again starting at the steps exemplified by block 358. If all the intervals have been checked, the algorithm preferably determines the number of solutions found. If only one solution is found (block 362), the process returns a positive indication (block 364). If no solutions are found, or if more than one solution is found, the process returns a negative indication (block 366).

Figure 12:
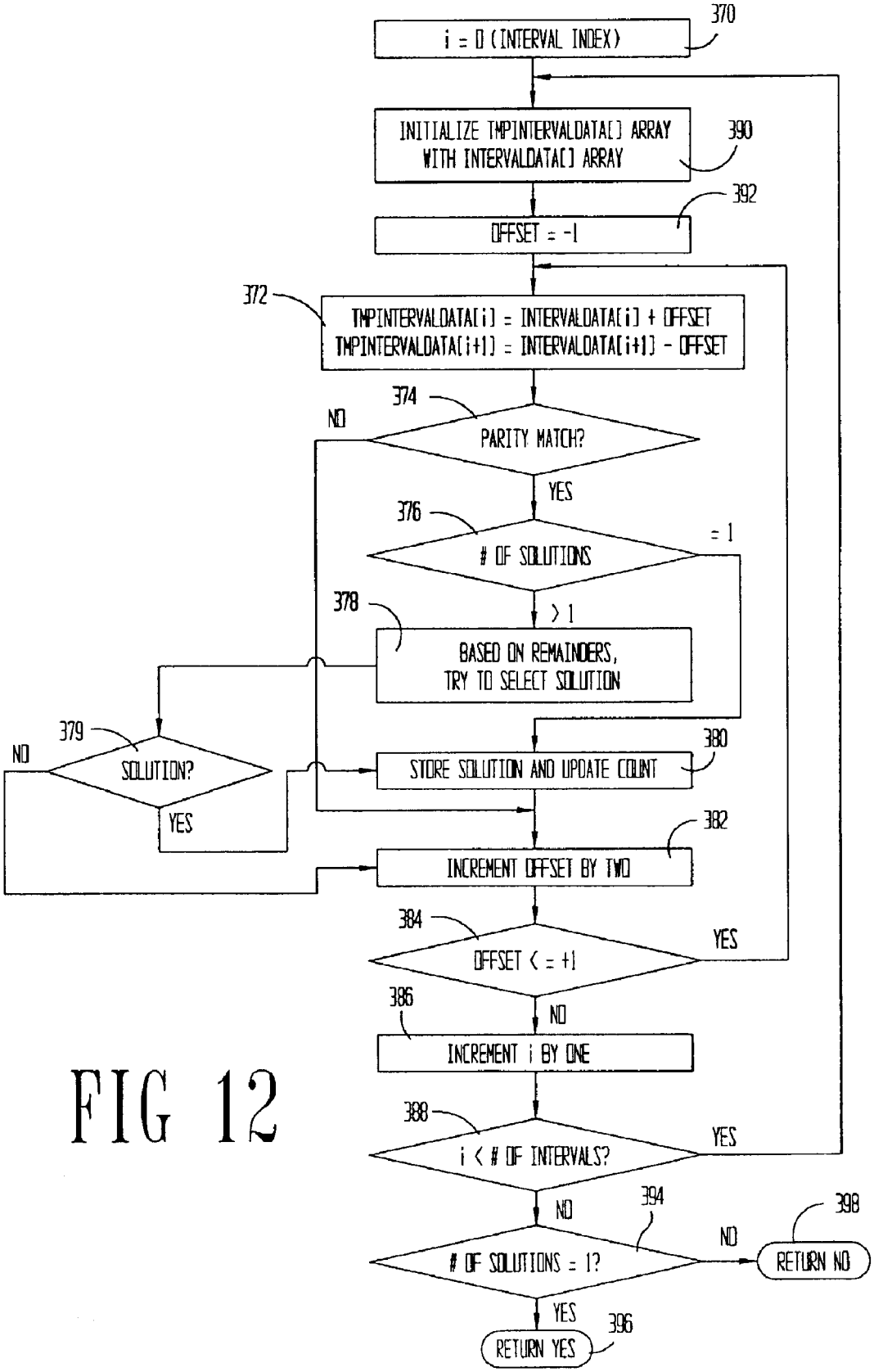
FIG. 12 shows an exemplary flow diagram of the "Shifted" error case.

FIG. 12 shows an exemplary flow diagram of the "Shifted" error theory case. This algorithm is designed to detect and correct, if possible, situations where a shift in one pulse causes one interval to become smaller, and a second interval to become larger. Alternatively, the pulse can shift such that the first interval becomes larger and the second interval becomes smaller. In summary, the "Shifted" error theory case, for contiguous intervals, shifts their values each direction and checks parity.

Referring to FIG. 12, preferably an interval index variable is zeroed (block 370), and a temporary interval data array is initialized with an interval data array (block 390). Thereafter, an offset variable is initialized to negative one (block 392). The interval data at the interval index variable has added to it the offset value, and the interval data at an immediately following interval index variable has the offset data subtracted therefrom (block 372). Using the modified interval data values, the algorithm preferably checks to see if there is a parity match (block 374). If the parity matches, the algorithm preferably determines the number of solutions (block 376). If this is the first solution found, the algorithm preferably stores the solution and updates the solution counter to be one (block 380). If more than one solution exists, the algorithm tries to select one of the solutions (block 378) based on the remainder of the decoding process. If one or more solutions can be selected from the multiple solutions (block 379), the algorithm preferably stores the solution(s) and updates a solution counter to be number of solutions that satisfy the criteria (block 380). Attempted selection of a solution in this "Shifted" case is similar to that of the "Off by one" case; however, in the "Shifted" case, two intervals may have been corrupted by a single errant pulse, and therefore embodiments of the invention check for solutions where the absolute value of the remainders of the intervals being tested prior to modification are greater than a quarter of a BIT-WIDTH (close to boundary) but have opposite sign (see FIG. 11A).

Whether the solution is stored (block 380), or the algorithm determines that the modified data values do not match parity (block 374), the offset variable is incremented by a value of two (block 382) and it is determined whether the offset exceeds the value of positive one (block 384). If the offset is positive one or less, the process preferably repeats beginning at the step exemplified by block 372. If the offset, after being incremented, exceeds positive one (block 384), the interval index value is preferably incremented by one (block 386) and a determination is made as to whether the incremented interval index variable exceeds the number of intervals (block 388). If the interval index variable does not exceed the number of intervals, preferably the process loops to begin anew with the steps exemplified in block 390. If all the intervals in the list have been checked, the process determines the number of solutions that were found (block 394). If only one unique solution is found, the algorithm returns a positive indication (block 396). If no solutions were found or more than one solution was found, the algorithm returns a negative indication (block 398).

The above discussion is meant to be illustrative of the principles and various embodiments of the present invention. Numerous variations and modifications will become apparent to those skilled in the art once the above disclosure is fully appreciated. For example, in Table 1, the long or synchronizing interval precedes the short intervals; however, the techniques may be equivalently implemented with the long or synchronizing interval trailing its short intervals. Further, one of ordinary skill, now understanding the specification, understands that the signal processor discussed could be a stand-alone computer, a set of computers, or dedicated devices such as digital signal processors. Finally, the system and method described herein are equally applicable to communications from downhole to surface devices, and from the surface to downhole devices. It is intended that the following claims be interpreted to embrace all such variations and modifications.

What is claimed is:

1. A method of pulse telemetry comprising:

receiving a long interval, the long interval having encoded therein a value greater than a value for short intervals;

receiving a plurality of short intervals, each of the plurality of short intervals having encoded therein a number of bits, and wherein the long interval and plurality of short intervals form a list;

checking for an error that may occur in the receipt of the list; and wherein the number of bits encoded in each of the plurality of short intervals is less than a number of parity bits.

2. The method as defined in claim 1 wherein the checking step further comprises checking for the error being one of: a missed pulse resulting in a false interval exceeding maximum value; a missed pulse resulting in the false interval being less than the maximum value; a pulse shift resulting in two intervals having invalid data; a pulse shift resulting in one interval having invalid data; or an extra pulse within an interval.

3. The method as defined in claim 2 wherein checking for an error being a missed pulse resulting in a false interval value exceeding a maximum value further comprises:

inserting a dummy interval;

adjusting values for each of the false interval and the dummy interval, the adjusting creating an adjusted false interval;

checking parity for the list for each adjustment of the adjusted false interval and dummy interval; and correcting the error if only one solution is identified by the adjusting and checking steps.

4. The method as defined in claim 3 further comprising:

determining, for each adjusted false interval and Dummy interval, whether a sum of the values of the adjusted false interval and dummy interval match the false interval value; and correcting the error if only one solution is identified by the adjusting, checking and determining steps.

5. The method as defined in claim 2 wherein checking for an error being a missed pulse resulting in the false interval being less than the maximum value further comprises:

inserting a dummy interval;

adjusting values of the false interval and the dummy interval, the adjusting creating an adjusted false interval;

checking parity for each adjusted false interval and dummy interval;

recording each set of values that produces a solution; and correcting the error if only one solution is identified.

6. The method as defined in claim 5 wherein recording further comprises, if multiple solutions exist, selecting a solution that produces two intervals having a total duration approximately equal to a duration of the false interval.

7. The method as defined in claim 5 further comprising skipping inserting a dummy interval, adjusting values, checking parity, recording each set of values and correcting the error if the false interval duration is less than twice a minimum interval duration (MIN-TIME) minus a bit width.

8. The method as defined in claim 2 wherein checking for an error being a pulse shift resulting in two intervals having invalid data further comprises:

adjusting values of contiguous intervals in the list;

checking parity for each adjustment of the contiguous intervals to determine if the values produce a valid solution;

applying a selection criteria if multiple valid solutions exists; and correcting the error if only one valid solution is identified.

9. The method as defined in claim 8 wherein applying a selection criteria further comprises comparing remainders of the contiguous intervals.

10. The method as defined in claim 9 further comprising choosing a solution where each remainder of the contiguous intervals have an absolute value greater than a quarter of a time window for receipt of a pulse defining a particular value.

11. The method as defined in claim 10 further comprising choosing the solution where a sign of each remainder is opposite.

12. The method as defined in claim 8 wherein step adjusting values further comprises:

adding a value of one to a first interval of the contiguous intervals, and subtracting a value of one to the second interval of the contiguous intervals; and subtracting a value of one to the first interval, and adding a value of one to the second interval.

13. The method as defined in claim 2 wherein checking for an error being a pulse shift resulting in one interval having invalid data further comprises:

adjusting a value of an interval in the list;

checking parity for each adjustment to determine if the value represents a valid solution;

applying a selection criteria if multiple valid solutions exists; and correcting the error if only one valid solution is identified.

14. The method as defined in claim 13 wherein applying a selection criteria further comprises choosing a solution where the remainder of the interval has an absolute value greater than a quarter of a time window for receipt of a pulse defining a particular value.

15. The method as defined in claim 13 wherein adjusting a value further comprises:

adding a value of one to the interval of the list; and subtracting a value of one to the interval of the list.

16. The method as defined in claim 2 wherein checking for an error being an extra pulse within an interval further comprises:

removing a shared pulse of a set of contiguous intervals in the list to create a test interval having a test interval value;

checking parity of the list using the test interval value;

recording the test interval value that produces a solution;

repeating removing a shared pulse, checking parity and recording the test interval value for a plurality of contiguous intervals; and correcting the error if only one solution is identified.

17. The method as defined in claim 16 further comprising performing checking parity and recording the test interval value only if the test interval duration is less than or equal to a maximum interval duration for the contiguous intervals.

18. The method as defined in claim 16 further comprising skipping steps of checking and recording if the test interval is greater than a maximum interval duration for the contiguous intervals.

19. The method as defined in claim 1 wherein receiving the long interval further comprises receiving the long interval having encoded therein the parity value having greater than four parity bits.

20. The method as defined in claim 19 wherein receiving the long interval further comprises receiving the long interval having encoded therein the parity value having five parity bits.

21. The method as defined in claim 1 further comprising:

sending a plurality of lists; and predicting a list identification number for a current list based on identification numbers of three or more previous lists.

22. The method as defined in claim 21 wherein predicting a list identification number further comprises:

skipping list identification numbers of a previous list if the previous list was an intermittent lists; and predicting the list identification number based on list identification numbers of three or more previous non-intermittent lists.

23. A pulse telemetry system comprising:

an assembly that creates pressure pulses in drilling fluid, data in the pressure pulses encoded using pulse position modulation;

a signal processor coupled to a pressure sensor, the signal processor and pressure sensor detects pressure pulses in the drilling fluid;

wherein the signal processor receives a long interval and a plurality of short intervals, the long interval having data encoded therein, and each of the plurality of short intervals having encoded therein values having a number of bits, the initial interval and data intervals part of a list, and wherein the number of bits encoded in each of the plurality of short intervals is less than a number of parity bits; and wherein the signal processor corrects an error that occurs in the receipt of the list.

24. The system as defined in claim 23 wherein the error that the signal processor corrects being one of: a missed pulse resulting in a false interval exceeding maximum value; a missed pulse resulting in the false interval being less than the maximum value; a pulse shift resulting in two intervals having invalid data; a pulse shift resulting in one interval having invalid data; or an extra pulse within an interval.

25. The system as defined in claim 24 wherein the signal processor is corrects an error being a missed pulse resulting in a false interval exceeding maximum value by:

inserting a dummy interval;

adjusting values for each of the false interval and the dummy interval, the adjusting creating an adjusted false interval;

checking parity for the list for each adjusted false interval and dummy interval; and correcting the error if only one solution is identified by the adjusting and checking steps.

26. The system as defined in claim 25 wherein the signal processor corrects an error by:

determining, for each adjustment of the false interval and the dummy interval, whether a sum of the values of the adjusted false interval and dummy interval values match the false interval value; and correcting the error if only one solution is identified by the adjusting, checking and determining steps.

27. The system as defined in claim 24 wherein the signal processor corrects an error being a missed pulse resulting in the false interval being less than the maximum value by:

inserting a dummy interval;

adjusting values of the false interval and the dummy interval, the adjusting creating an adjusted false interval;

checking parity for each adjusted false interval and dummy interval;

recording each set of values that produces a solution; and correcting the error if only one solution is identified.

28. The system as defined in claim 27 wherein if multiple solutions exist, the signal processor selects a solution that produces two intervals having a total duration approximately equal to a duration of the false interval.

29. The system as defined in claim 28 wherein the signal processor skips inserting a dummy interval, adjusting values, checking parity, recording each set of values and correcting the error if the false interval duration is less than twice a minimum interval duration (MIN-TIME) minus a bit width.

30. The system as defined in claim 24 wherein the signal processor corrects an error being a pulse shift resulting in two intervals having invalid data by:

adjusting values of contiguous intervals in the list;

checking parity for each adjustment of the contiguous intervals to determine if the values produce a valid solution;

applying a selection criteria if multiple valid solutions exists; and correcting the error if only one valid solution is identified.

31. The system as defined in claim 30 wherein signal processor applies selection criteria by comparing remainders of the contiguous intervals.

32. The system as defined in claim 31 wherein the signal processor chooses solution where each remainder of the contiguous intervals has an absolute value greater than a quarter of a time window for receipt of a pulse defining a particular value.

33. The system as defined in claim 32 wherein the signal processor chooses solutions where a sign of each remainder is opposite.

34. The system as defined in claim 30 wherein to adjust values of contiguous intervals the signal processor adds a value of one to a first interval of the contiguous intervals, and subtract a value of one to the second interval of the contiguous intervals in one instance, and subtract a value of one to the first interval, and add a value of one to the second interval in another instance.

35. The system as defined in claim 24 wherein the signal processor corrects an error being a pulse shift resulting in one interval having invalid data by:

adjusting a value of an interval in the list;

checking parity for each adjustment to determine if the value represents a valid solution;

applying a selection criteria if multiple valid solutions exists; and correcting the error if only one valid solution is identified.

36. The system as defined in claim 35 wherein the signal processor chooses a solution where the remainder of the interval has an absolute value that is greater than a quarter of a time window for receipt of a pulse defining a particular value.

37. The system as defined in claim 35 wherein to adjust the value of an interval in the list the signal processor adds a value of one to the interval of the list in one instance, and subtract a value of one to the interval of the list in another instance.

38. The system as defined in claim 24 wherein the signal processor corrects an error being an extra pulse by:

removing a shared pulse of a set of contiguous intervals in the list to create a test interval having a test interval value;

checking panty of the list using the test interval value;

recording the test interval value that produces a solution;

repeating steps a) through c) for a plurality of contiguous intervals; and correcting the error if only one solution is identified.

39. The system as defined in claim 38 wherein if the test interval duration is greater than a maximum interval duration for the contiguous intervals the signal processor skips checking parity, recording the test interval value, repeating and correcting the error.

40. The system as defined in claim 23 wherein the initial interval has encoded therein the parity value having greater than four parity bits.

41. The system as defined in claim 40 wherein the initial interval has encoded therein the parity value having five parity bits.

42. The system as defined in claim 23 wherein the signal processor predicts a list identification number for a current list based on identification numbers of three or more previous lists.

43. The system as defined in claim 42 wherein the signal processor skips a list identification number of a previous list if the previous list was an intermittent list, and predict the list identification number based on list identification numbers of three or more previous non-intermittent lists.

44. In a pulse telemetry system where data is transmitted to the surface in lists, a method comprising:

receiving a plurality of lists, each list comprising an synchronizing interval and a plurality of smaller intervals, each smaller interval having encoded therein a maximum number of N bits, each synchronizing interval having encoded therein at least N+1 bits, and wherein each list comprises at least N+1 parity bits;

wherein some of the plurality of lists from a predetermined set sent in a predetermined order, and some of the plurality of lists sent only intermittently; and predicting a list identification number for a current list based on identification numbers of three or more previous lists of the predetermined set.

45. The method as defined in claim 44 wherein predicting a list identification number further comprises:

skipping list identification numbers of a previous list if the previous list was an intermittent list; and predicting the list identification number based on list identification numbers of three or more previous non-intermittent lists.

46. The method as defined in claim 44 wherein the synchronizing interval has encoded therein the N+1 parity bits.

47. The method as defined in claim 46 wherein each synchronizing interval has encoded therein five parity bits.

48. The method as defined in claim 46 wherein each smaller interval has values encoded therein of four bits.

* * * * *